United States Patent [19]

Parrish et al.

[11] 4,378,844

[45] Apr. 5, 1983

[54] EXPLOSIVE CUTTING SYSTEM

[75] Inventors: David D. Parrish; John A. Barton, both of Spring, Tex.

[73] Assignee: NL Industries, Inc., New York, N.Y.

[21] Appl. No.: 53,298

[22] Filed: Jun. 29, 1979

[51] Int. Cl.[3] ..... E21B 29/02

[52] U.S. Cl. ..... 166/297; 166/55.1; 102/313

[58] Field of Search ..... 102/20, 21, 21.6, 24 HC; 166/297, 55, 55.1; 175/4.51, 4.52

[56] References Cited

U.S. PATENT DOCUMENTS

| | | | |
|---|---|---|---|
| 2,831,429 | 4/1958 | Moore | 102/20 |
| 3,238,871 | 3/1966 | Lang | 102/20 |
| 4,184,430 | 1/1980 | Mock | 166/297 |
| 4,290,486 | 9/1981 | Regalbuto | 166/297 |

OTHER PUBLICATIONS

Fundamental Demolition Techniques, Paper delivered at meeting of American Ordinance Association, Fall 1967, S. Moses, p. 7.

*Primary Examiner*—William F. Pate, III

*Attorney, Agent, or Firm*—Browning, Bushman, Zamecki & Anderson

[57] ABSTRACT

Disclosed are method and apparatus for cutting tubular members from the inside by use of an explosive-induced shock wave. In a particular disclosed embodiment, an electric detonator is used to initiate two equal lengths of linear explosives, each of which initiates a non-electric detonator, to provide dual simultaneous detonation of both ends of an elongate high explosive charge distribution. The resulting collision of detonation shock fronts at or near the center of the explosive charge diverts the shock energy 90° into a 360° distribution about the axis of the charge distribution in a plane perpendicular to that axis to provide the energy to cut a tubular member circumscribing the explosive charge.

17 Claims, 5 Drawing Figures

EXPLOSIVE CUTTING SYSTEM

BACKGROUND OF THE INVENTION

1. Field of the Invention

The present invention pertains to methods and apparatus for cutting tubular members, such as pipe members. More particularly, the present invention relates to techniques for cutting tubular members, particularly metal pipe, from the inside using explosive charges. Such techniques find particular application in cutting pipe members positioned at remote or inaccessible locations, such as within wells, where the use of conventional pipe cutting practices is prohibited.

2. Description of Prior Art

In operations on wells, particularly deep wells as are known in the oil and gas industry, occasionally pipe members situated downhole must be severed or cut loose. Such occasions arise, for example, when drill strings or drill collars become stuck in the well and cannot be retrieved.

It is known to sever such stuck drill collars or drill string at a desired location in the well by using an explosive cutting device. Such a tool is lowered into the well, usually on a wireline, and positioned at the location where the tube cut is to be made. To assist in placing the explosive device at the correct position, a locator may be lowered with the cutting device to locate the pipe member to be cut. An electric detonator within the explosive device is initiated by an electric signal from equipment at the surface, and in turn initiates a fuse which detonates a high explosive charge. The shock effect from the high explosive charge breaks up the surrounding tubing in the vicinity of the explosion, thereby severing the tube.

In view of the danger inherent in the use of high explosives, particularly in oil and gas wells, it is desirable to effect the cutting of such tubing with maximized efficiency, utilizing the minimum amount of explosive charge necessary. Additionally, it is desirable to leave the well after the cutting of the tubing with as little debris as possible. For example, if the portion of the tubing remaining in the well after the cutting operation includes segments that are twisted and bent to obstruct the central passage in the well, such material may prevent further operations in the well until the obstructions are cleared. Consequently, it is advantageous to provide a tube cutting technique which makes as clean and neat a cut in the tubing as possible.

SUMMARY OF THE INVENTION

The present invention provides apparatus for cutting or severing tubular members. An explosive charge is distributed along the interior of an elongate housing which may be positioned within the tubular member to be cut. Means are provided for simultaneously detonating both ends of the explosive charge. The resulting shock fronts generated by the detonation of the explosive material travel toward each other from the opposite ends of the explosive charge as the explosions progress. The collision of the shock fronts at or near the center of the elongate explosive charge distribution diverts the energy from the shock waves 90° into a radial plane generally perpendicular to the longitudinal axis of the explosive charge distribution. The diverted shock front transmits energy in all directions in this radial plane to thereby promote cutting of the tubing member.

Detonation of the explosive charge distribution may be carried out by use of two non-electric detonators, or blasting caps, one positioned at and in communication with each end of the elongate explosive charge distribution. The non-electric blasting caps may be simultaneously initiated by use of a single electric detonator or blasting cap, initiated by an electric signal. Two equal lengths of mild detonating fuze, serving as transmission lines, are used to connect the electric detonator to the non-electric blasting caps. The mild detonating fuzes may be in the form of explosive material packed in flexible metal tubing extending from the electric detonator to each of the two non-electric detonators. The fuzes are uniform and of equal lengths to insure that the non-electric detonators are initiated simultaneously after the simultaneous initiation of the fuzes by the electric detonator.

The high explosive charge distribution may be constructed in the form of an array of pellets of the explosive material. To enhance the communication of the explosive energy radially to the surrounding tubular member to be cut, a metal pellet may be positioned within the high explosive charge array at the center of the array where the two explosive shock fronts collide. The metal pellet then absorbs the shock energy and liquifies. The liquified metal transmits the energy to the surrounding tubular member to be cut. More than one such metal pellet may be used for such purpose.

In a method of the invention, an elongate explosive charge distribution is simultaneously initiated at both ends to generate shock fronts propogating toward each other which collide at or near the center of the explosive charge distribution. The diversion of the colliding shock fronts radially outwardly perpendicular to the elongate axis of the charge distribution provides the energy for cutting a surrounding tubular member. The explosive charge distribution is so simultaneously initiated at both ends by initiating an electric detonator with an appropriate electric signal to initiate simultaneously a pair of linear fuzes of equal lengths. The fuzes then simultaneously initiate a pair of non-electric detonators in communication with the opposite ends of the high explosive charge distribution. The colliding shock fronts may be made to liquify a metal segment positioned at or near the center of the high explosive charge distribution to transmit cutting forces to the surrounding tubing to be cut by means of the liquified metal.

The present invention provides a technique for maximizing the transmission of explosive shock energy radially outwardly to operate upon a surrounding tubular member to be cut. Further, the shock energy thus transmitted to the tubing to be cut is relatively confined to the vicinity of a plane perpendicular to the longitudinal axis of the tubing to be cut. The cutting forces are thus confined to a relatively narrow annular band about the tubing to be cut to minimize the tearing and breaking of the resulting ends of the tubing.

DESCRIPTION OF PREFERRED EMBODIMENTS

Figure 1:
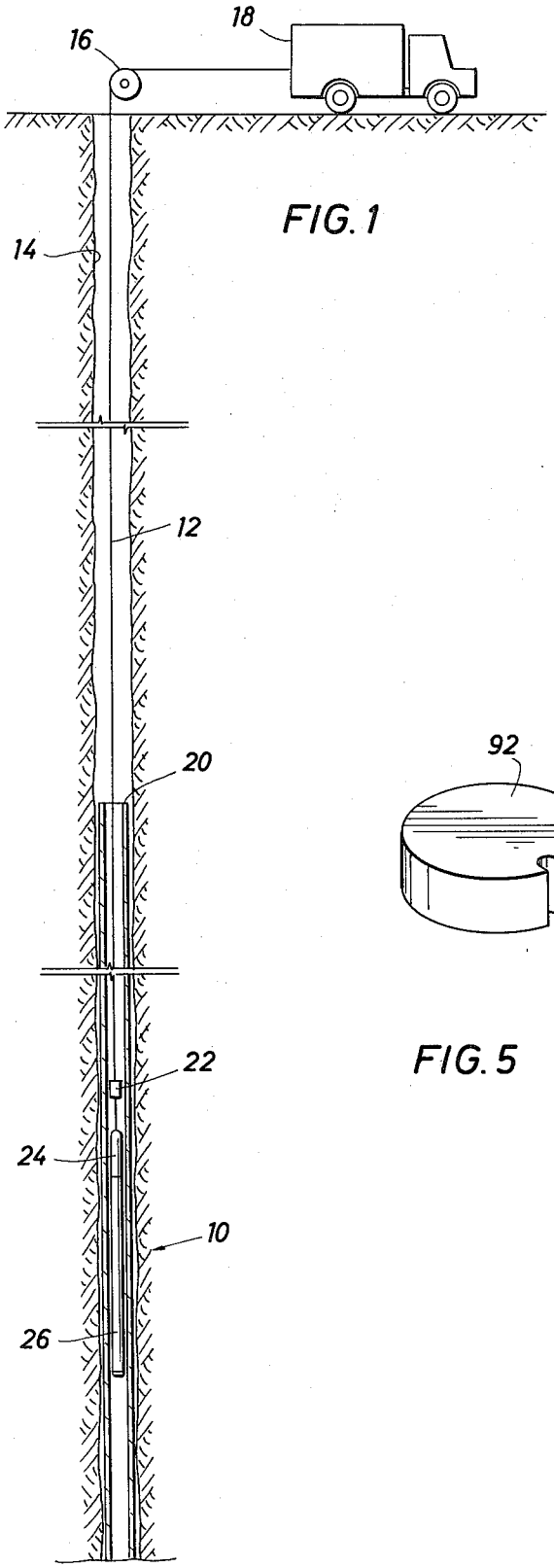
FIG. 1 is a schematic side elevation showing a cross section through a well in which an explosive cutting device according to the present invention has been positioned by use of a wireline truck.

An explosive cutting device according to the present invention is shown generally at 10 in FIG. 1 suspended by a wireline 12 in a well 14. The wireline 12 passes over a sheave 16 at the surface and is shown leading to a control truck 18. The wireline 12 may include an appropriate cable by which control signals may be communicated between the truck 18 and the explosive device 10. The position in the well 14 of the explosive device 10 may be determined by monitoring movement of the wireline 12 as the explosive device is lowered in the well.

The explosive cutting device 10 is illustrated as located downhole within a drill collar, or pipe member 20. The pipe member 20 may be severed at the location of the explosive cutting device 10. A locator 22 is lowered on the wireline 12 with the explosive cutting device 10 to more particularly locate the pipe member 20 to be cut. When the explosive cutting device 10 is appropriately positioned as desired, an electronic signal may be transmitted from the control truck 18 to appropriate receiving instrumentation positioned within a protective shock tube 24 joined to the explosive cutting device housing 26. The electronic signal causes the initiation of an explosive train resulting in the cutting of the pipe member 20 in the vicinity of the explosive cutting device 10 as described in further detail hereinafter.

Figure 2:
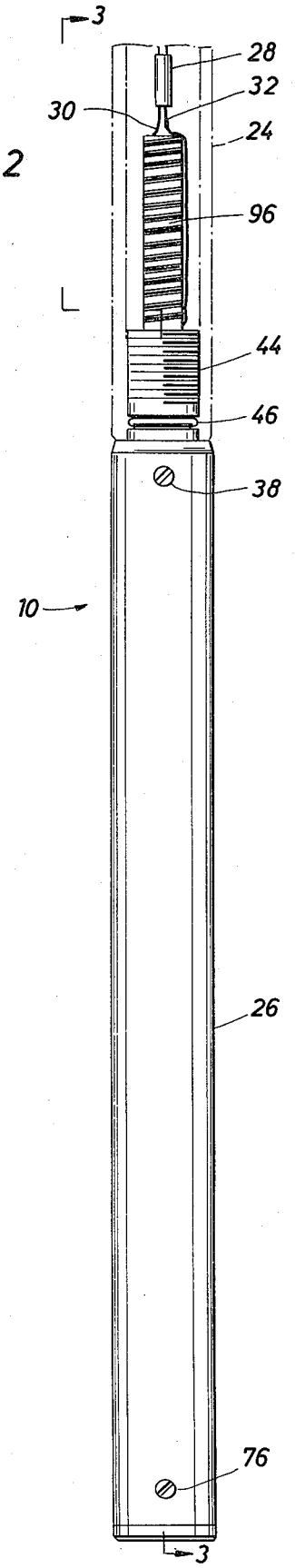
FIG. 2 is a side elevation of an explosive cutting device according to the present invention with the shock tube removed to reveal a portion of the top cap assembly.
Figure 3:
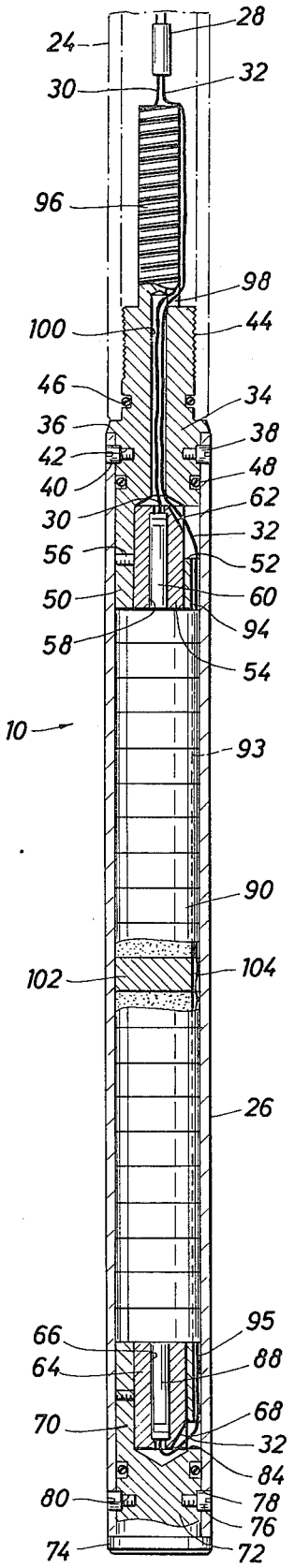
FIG. 3 is a side elevation in partial section of the explosive cutting device of FIG. 2, taken generally along line 3—3 therein.

Details of the structure of the explosive device 10 may be appreciated by reference to FIGS. 2 and 3, wherein the shock tube 24 is indicated as removed to reveal the technique of positioning a portion of the explosive train.

An electric detonator, or blasting cap, 28 receives a triggering electric signal ultimately from the control truck 18. A pair of mild detonating fuzes 30 and 32 is in communication with the electric detonator 28 so that the electric detonator may initiate the two fuzes. Each of the fuzes 30 and 32 includes explosive material packed within a flexible metal tubing, such as aluminum tubing. As an alternative, virtually any elongate flexible tubed fuzing, such as the explosive sold under the trademark PRIMACORD, may be used. PRIMACORD includes a powdered explosive confined in a flexible plastic jacket.

The two fuzes 30 and 32 are alike in construction and are of equal lengths. Consequently, the two fuzes detonate at the same rate or velocity, and require equal time intervals to detonate their respective entire lengths.

A top cap assembly 34 is received by one end of the housing 26. An annular shoulder 36 limits the extent of insertion of the assembly 34 within the housing 26. A pair of bolts 38 are then inserted through holes 40 in the housing 26 and engaged in appropriately threaded bores 42 in the assembly 34. The heads of the bolts 38 reside within the holes 40 to lock the top cap assembly 34 to the housing 26. Details of the top cap assembly 34 may be appreciated by reference to the enlarged view in FIG. 4 wherein is shown a modified top cap assembly 34A that differs from the assembly 34 as described hereinafter.

The top cap assembly 34 includes a threaded portion 44 by which the shock tube 24 is held in place. An O-ring seal 46, residing in an appropriate annular groove in the top cap assembly 34, provides a fluid-tight seal to prevent the influx of well fluid within the shock tube 24. A second O-ring seal 48, carried in an appropriate annular groove within the top cap assembly 34, provides a similar fluid-tight seal between the top cap assembly and the housing 26.

The bottom of the top cap assembly 34 ends in a generally tubular, downwardly-facing segment 50 which features a side opening 52. The tubular segment receives a generally cylindrical detonator retainer 54, which is then held in place by a set screw 56 positioned within an appropriate threaded bore in the side of the tubular segment 50.

The detonator retainer 54 includes a central passage 58 which receives a non-electric blasting cap 60. A beveled cut 62 at one end of the retainer 54 provides a side opening aligned with the side opening 52 of the tubular segment 50. The detonator retainer 54 may be in the form of a rubber grommet. A similar detonator retainer 64, including a central passage 66 and a beveled side opening 68, is positioned within a generally tubular segment 70 of a bottom cap assembly 72 received within the lower end of the housing 26. An annular flange 74 limits the insertion of the bottom cap assembly 72 within the housing 26. A pair of bolts 76 are then passed through appropriate holes 78 in the housing 26 and engaged in threaded bores 80 within the bottom cap assembly 72. The heads of the bolts 76 reside within the holes 78 to lock the bottom cap assembly to the housing 26. An O-ring seal 82 is carried by an appropriate annular groove in the bottom cap assembly 72 to provide a fluid-tight seal between the assembly 72 and the housing 26. Both the top cap assembly 34 and the bottom cap assembly 32 are thus anchored and sealed to the housing 26.

The tubular segment 70 also includes a side opening 84 with which the retainer side opening 68 may be aligned. A set screw 86 is engaged within a appropriate threaded bore in the tubular segment 70 to lock the lower detonator retainer 64 relative to the bottom cap assembly 72.

A non-electric blasting cap 88 is held within the central passage 66 of the lower detonator retainer 64. The two blasting caps 60 and 88 are alike, and may include any conventional type of chemical high explosive, such as RDX.

The fuze 30 is connected to the upper non-electric blasting cap 60. The other fuze 32 extends the length of the housing 26 and is connected to the lower non-electric blasting cap 88. The two fuzes 30 and 32 are thus configured to initiate the two blasting caps 60 and 88, respectively.

Figure 5:
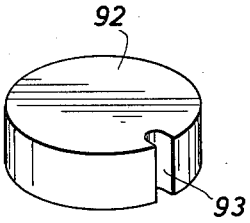
FIG. 5 is a view in perspective of a pellet of high explosive material used in constructing the high explosive charge distribution.

Between the upper and lower non-electric blasting caps 60 and 88, respectively, is an elongate distribution of high explosive material 90, such as RDX for example. The explosive material 90 is in the form of a collection of waferlike pellets 92, illustrated in detail in FIG. 5. Each of the pellets 92 includes a groove 93 extending along the side of the pellet the full height of the pellet.

All of the pellets 92 are arranged in an array between the bottom of the top cap assembly 34 with the upper detonator retainer 54 and upper detonator 60, and the top of the bottom cap assembly 72 with the lower detonator retainer 64 and the lower detonator 88. Further, all of the pellet grooves 93 are mutually aligned and are generally oriented relative to the housing 26 in line with the side openings 52 and 84 of the upper and lower cap assemblies 34 and 72, respectively.

The aligned side openings 62 and 52, 84 and 68 along with the pellet grooves 93 receive the mild detonating fuze 32 which extends the length of the housing 26 to communicate with the lower non-electric detonator 88. The top cap assembly tubular segment 50 and the bottom cap assembly tubular segment 70 feature longitudinal grooves 94 and 95, respectively, aligned with the respective side openings 52 and 84 to accommodate passage therethrough of the fuze 32.

Since the explosive array 90 is oriented longitudinally relative to the electric detonator 28, the upper non-electric detonator 60 is necessarily closer physically to the electric detonator. Consequently, with both fuzes 30 and 32 the same length, the fuze 30 communicating with the upper non-electric blasting cap 60 is coiled around a threaded spool 96 extending upwardly as part of the top cap assembly 34 in FIGS. 2 and 3. The fuze 32 extends downwardly along the outside of the spool 96. At the base of the spool 96, both fuzes 30 and 32 enter a side port 98 to a central passage 100 extending downwardly to the interior of the tubular segment 50. There, the fuze 30 enters the retainer passage 58 and connects to the upper non-electric blasting cap 60. The fuze 32 passes through the beveled opening 62 of the upper detonator retainer 54 and out through the side opening 52 of the tubular segment 50. The fuze 32 then enters the alignment of pellet grooves 96 and emerges at the bottom cap assembly 72 where the fuze 32 passes through the side openings 84 and 68 to the interior of the tubular member 70. There the fuze 32 passes into the central passage 66 to the lower detonator retainer 64 and connects with the lower non-electric blasting cap 88.

Figure 4:
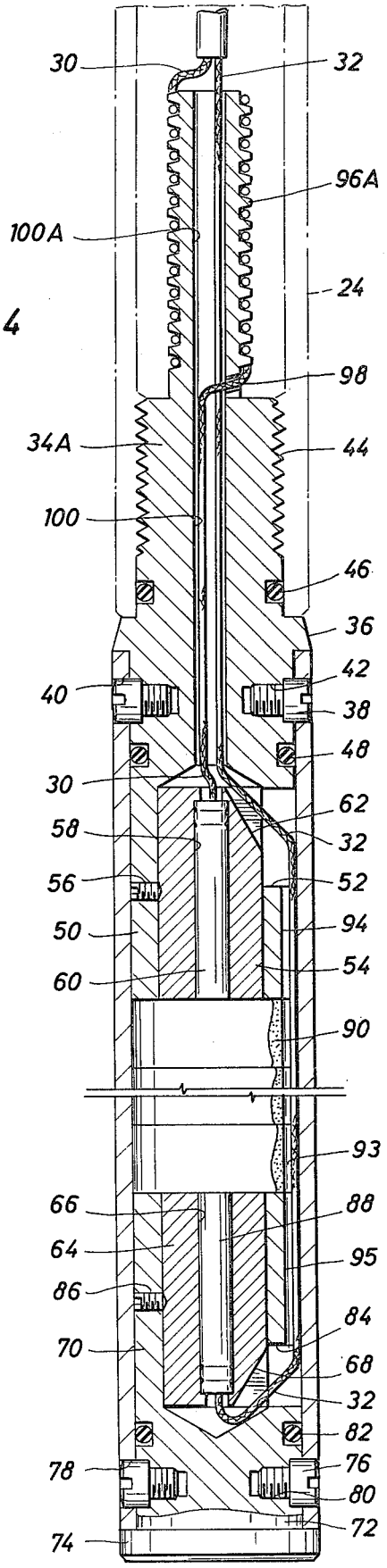
FIG. 4 is a side elevation in cross section of an explosive cutting device according to the present invention, illustrating an alternate top cap assembly.

The top cap assembly 34A illustrated in FIG. 4 differs from the top cap assembly 34 of FIGS. 2 and 3 only in that the spool 96A of the embodiment of FIG. 4 includes an upper extension 100A of the top cap assembly central passage 100. The mild detonating fuze 30 is wrapped about the threads of the spool 96A before passing into the interior passage 100 through the side port 98 at the base of the spool while the other fuze 32 enters the passage 100A at the top of the spool 96A and extends downwardly through the passage 100 to the side openings 62 and 52 as in FIGS. 2 and 3. The fuze 30 continues along the passage 100 to the upper non-electric blasting cap 60.

Once the explosive cutting device 10, according to either FIGS. 2 and 3, or FIG. 4, is positioned within a tubular member to be cut, such as the pipe member 20 of FIG. 1, an electric signal may be transmitted to the electric detonator 28 to initiate same. Detonation of the detonator 28 causes simultaneous initiation of the two mild detonating fuzes 30 and 32. These two fuzes detonate at the same velocity. Consequently, the upper and lower non-electric detonators 60 and 88 are initiated simultaneously in response to the detonation of the fuzes 30 and 32, respectively. The dual simultaneous initiation of the detonators 60 and 88, and their respective detonation, causes simultaneous initiation of the two opposite ends of the high explosive charge distribution 90. Thus, the extreme upper and lower pellets 92 are initiated simultaneously. The detonation of the array of pellets 92 proceeds from the opposite ends of the array simultaneously and at the same velocity. As subsequent explosive material 90 is initiated, the advancing shock wave energy increases the two shock fronts approaching each other toward the center of the explosive array 90. The shock fronts collide at the center of the array 90, with resultant diversion of the shock energy at the point of collision into all directions in a plane perpendicular to the longitudinal axis of the charge array. Consequently, the shock energy radiates outwardly about 360° in a plane generally perpendicular to the longitudinal axis of the housing 26. This explosive shock energy disintegrates the housing 26 and the surrounding pipe member 20 generally in the same plane to which the energy is diverted. Because of the collision effect of the two shock fronts, this outwardly-directed shock energy is generally well defined in direction of propogation to lie in the aforementioned plane. Thus, shock forces acting on the pipe member 20 to cut the pipe member are fairly well confined within a narrow annular band intersecting the pipe member at the aforementioned plane, which is generally positioned at the center of the high explosive charge distribution 90.

To enhance the transmission of the shock energy toward the pipe member to be cut, a pellet of lead or other metal 102 (FIG. 3) is positioned aligned with the explosive material pellets 92 at the center of the explosive charge distribution 90. The two shock fronts generated by the detonation of the explosive pellets 92 then collide at the metal pellet 102. The incidence of the high energy shock fronts on the metal pellet 102 causes this pellet to liquify. The diversion of the shock fronts then occurs in the environment of the liquified metal pellet, and the shock energy thus diverted is transmitted, at least in part, to the surrounding tubular member 20 to be cut by the liquified metal being propelled radially outwardly. The metal thus acts to absorb shock energy, and to transmit cutting forces to the surrounding pipe member to be cut. In such case, the shock wave propogating radially outwardly generally along the aforementioned plane perpendicular to the longitudinal axis of the high explosive charge distribution 90 is not only acoustic, but also propels liquified matter therewith. Consequently, it may be expected that the shock energy incident on the tubular member to be cut may be even more concentrated along the annular intersection of the aforementioned plane with the tubular member when the metal plate 102 is thus utilized. To accommodate the passage of the fuze 32 along the interior of the housing 26, the metal pellet 102 also features an elongate groove 104 aligned with the grooves 93 of the explosive material pellets 92.

It will be appreciated that the present invention provides a technique for explosively cutting a tubular member from the inside, which technique insures that the cutting forces are concentrated in a narrow, annular band intersecting the tubular member. Further, since the cutting technique of the present invention employs the mutual deflection of two advancing explosive-induced shock fronts, a relatively large amount of cutting energy may be generated and appropriately deflected to cut the tubular member utilizing a relatively small amount of explosive charge.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Apparatus for cutting tubular members comprising:

a. a generally elongate distribution of explosive material having first and second ends;

b. a first non-electric detonator for communication with said first end of said distribution of explosive material for initiating said explosive material;

c. a second non-electric detonator for communication with said second end of said distribution of explosive material for initiating said explosive material;

d. an electrical blasting cap;

e. first mild detonating fuze means for communication between said blasting cap and said first detonator whereby detonation of said blasting cap effects initiation of said first detonator; and f. second mild detonating fuze means for communication between said blasting cap and said second detonator whereby detonation of said blasting cap effects initiation of said second detonator;

g. wherein said first and second mild detonating fuze means are mutually equal in length and equal in velocity of detonation, whereby initiation of said blasting cap to simultaneously initiate said first and second mild detonating fuze means effects simultaneous initiation of said first and second ends of said generally elongate distribution of explosive material.

2. Apparatus as defined in claim 1 further comprising energy absorbing and communication means positioned generally at the center of said distribution of explosive material for absorbing at least a portion of the energy of the explosion of said distribution of explosive material and transmitting at least a portion of said energy so absorbed to such tubular member to be cut.

3. Apparatus as defined in claim 2 wherein said energy absorbing and communication means comprises at least one metal pellet.

4. Apparatus as defined in claim 3 wherein:

(a) said distribution of explosive material comprises a plurality of pellets of explosive material arranged in a generally linear array; and (b) said metal plates are positioned within said linear array with an equal number of pellets of explosive material on either side of said metal pellets.

5. Apparatus as defined in claim 1 wherein said distribution of explosive material comprises a plurality of pellets of explosive material arranged in a generally linear array.

6. Apparatus as defined in claim 5 further comprising at least one metal pellet positioned within said linear array with an equal number of said pellets of explosive material on either side of said metal pellets.

7. Apparatus for cutting tubular members explosively comprising:

(a) an elongate housing for positioning within such a tubular member to be so cut;

(b) an elongate distribution of explosive material positioned within said housing;

(c) a first detonator for communication with a first end of said distribution of explosive material for initiating said explosive material;

(d) a second detonator for communication with a second end of said distribution of explosive material for initiating said explosive material;

(e) a blasting cap;

(f) a first fuze for communication between said blasting cap and said first detonator for initiating said first detonator;

(g) a second fuze for communication between said blasting cap and said second detonator for initiating said second detonator; and (h) wherein said first and second fuzes require equal time intervals for detonation thereof whereby simultaneous iniation of said first and second fuzes effects simultaneous initiation of said first and second ends of said distribution of explosive material.

8. Apparatus as defined in claim 7 wherein:

(a) said first fuze comprises a first mild detonating fuze; and (b) said second fuze comprises a second mild detonating fuze of length equal to the length of said first mild detonating fuze.

9. Apparatus as defined in claim 8 or, in the alternative, as defined in claim 7 wherein said distribution of explosive material comprises a plurality of pellets of explosive material arranged in a generally linear array.

10. Apparatus as defined in claim 9 further comprising at least one metal pellet positioned within said linear array with an equal number of said pellets of explosive material on either side of said metal pellets.

11. Apparatus as defined in claim 10 wherein said blasting cap comprises an electric detonator.

12. Apparatus as defined in claim 8 wherein each of said first fuze and said second fuze comprises metal tubing containing explosive material.

13. Apparatus as defined in claim 8 or, in the alternative, as defined in claim 7 further comprising spool means on which is wound at least a portion of said first fuze.

14. A method of cutting tubular members explosively comprising the following steps:

a. providing an elongate distribution of explosive material having a detonator at each end thereof for initiation of the two opposite ends of the distribution of explosive material, a blasting cap, and two fuzes of equal length with each fuze communicating between the blasting cap and one of the detonators, each fuze so communicating with a different one of the detonators;

b. positioning the distribution of explosive material generally within such a tubular member; and c. initiating the blasting cap, thereby simultaneously initiating the two fuzes whereby the two detonators are simultaneously initiated by the two fuzes, and both opposite ends of the distribution of explosive material are simultaneously initiated by the detonation of the two detonators.

15. Apparatus as defined in claim 14 further comprising the additional step of providing a metal pellet at the center of said elongate distribution of explosive material before carrying out the step of substantially initiating said distribution of explosive material at both opposite ends thereof.

16. A method of cutting tubular members in wells comprising:

(a) providing an elongate distribution of explosive material arranged along the interior of an elongate housing, and fitted with a detonator at each end of said distribution of explosive material, each detonator connected to a blasting cap by a fuze, said two fuzes being of equal length and detonation velocity;

(b) positioning said housing in such well generally along the tubular member to be cut, and (c) initiating said blasting cap.

17. A method of cutting tubular members in wells comprising:

(a) providing an elongate distribution of explosive material, including metal energy absorbing means located generally at the center of said distribution, arranged along the interior of an elongate housing, and fitted with a detonator at each end of said distribution of explosive material, each detonator connected to a blasting cap by a fuze, said two fuzes being of equal length and detonation velocity;

(b) positioning said housing in such well generally along the tubular member to be cut; and (c) initiating said blasting cap.

* * * * *

UNITED STATES PATENT AND TRADEMARK OFFICE

CERTIFICATE OF CORRECTION

PATENT NO. : 4,378,844

DATED : April 5, 1983

INVENTOR(S) : David D. Parrish; John A. Barton

It is certified that error appears in the above—identified patent and that said Letters Patent is hereby corrected as shown below:

In Column 8, line 58, delete "substantially" and insert therefor --simultaneously--.

Signed and Sealed this

Twenty-seventh Day of November 1984

[SEAL]

*Attest:*

GERALD J. MOSSINGHOFF

*Attesting Officer*

*Commissioner of Patents and Trademarks*